US007409781B2

(12) United States Patent
Azam et al.

(10) Patent No.: US 7,409,781 B2
(45) Date of Patent: Aug. 12, 2008

(54) ARTICLE OF FOOTWEAR WITH LINKAGE-TIGHTENING DEVICE

(75) Inventors: Guy Azam, Aix-les-Bains (FR); Jean-Bruno Danezin, Chilly (FR); Eric Pierre, Annecy (FR); Bruno Borsoi, Victorio Veneto (IT)

(73) Assignee: Salomon S.A., Metz-Tessy (FR)

( * ) Notice: Subject to any disclaimer, the term of this patent is extended or adjusted under 35 U.S.C. 154(b) by 255 days.

(21) Appl. No.: 11/442,990

(22) Filed: May 31, 2006

(65) Prior Publication Data

US 2006/0213085 A1 Sep. 28, 2006

Related U.S. Application Data

(60) Division of application No. 10/944,050, filed on Sep. 20, 2004, now Pat. No. 7,281,342, which is a continuation of application No. 09/926,086, filed as application No. PCT/FR00/03661 on Dec. 22, 2000, now Pat. No. 6,802,439.

(30) Foreign Application Priority Data

Dec. 28, 1999 (FR) ..... 99 16846
May 26, 2000 (FR) ..... 00 06960

(51) Int. Cl.
*A43B 5/04* (2006.01)

(52) U.S. Cl. ..... 36/50.5

(58) Field of Classification Search ..... 36/50.5, 36/50.1; 294/153, 162, 164, 170, 171
See application file for complete search history.

(56) References Cited

U.S. PATENT DOCUMENTS 4,200,998 A 5/1980 Adams ..... 36/50
RE31,052 E 10/1982 Adams ..... 36/50
4,791,702 A 12/1988 McVey ..... 16/428
4,967,454 A 11/1990 Elieff ..... 24/712.1
5,131,707 A 7/1992 Zazzara et al. ..... 294/156
5,477,593 A 12/1995 Leick ..... 24/712.5
5,853,213 A 12/1998 Simpson ..... 294/158
5,956,823 A 9/1999 Borel ..... 24/712.9
5,971,458 A 10/1999 Contreras et al. ..... 294/150
5,979,080 A 11/1999 Borsoi ..... 36/50.1
6,467,195 B2 10/2002 Pierre et al. ..... 36/50.5
6,473,999 B2 11/2002 Fellouhe ..... 36/50.1
6,802,439 B2 10/2004 Azam et al. ..... 223/113
7,281,342 B2 * 10/2007 Azam et al. ..... 36/50.5
2001/0025434 A1 10/2001 Fellouhe

FOREIGN PATENT DOCUMENTS

DE 8714500 12/1987
DE 19710702 9/1998

(Continued)

*Primary Examiner*—Ted Kavanaugh
(74) *Attorney, Agent, or Firm*—Greenblum & Bernstein, P.L.C.

(57) ABSTRACT

A lace-up device for tightening an article of footwear, providing for the tieing of the lacing without causing discomfort to the user's hands, as well as to the article of footwear equipped with such device. The lace-up device includes a gripping mechanism arranged on the linkage in the area of a loop formed by the lacing outside the tightening zone. The gripping device includes a rigid frame, making it possible to distribute the tension of the lacing over the hand of the user.

24 Claims, 3 Drawing Sheets

FOREIGN PATENT DOCUMENTS

| | | |
|---|---|---|
| EP | 0923886 | 6/1999 |
| EP | 1034712 | 9/2000 |
| FR | 2473280 | 7/1981 |
| FR | 2706743 | 12/1994 |
| FR | 2752686 | 3/1998 |
| FR | 2757026 | 6/1998 |

* cited by examiner

ARTICLE OF FOOTWEAR WITH LINKAGE-TIGHTENING DEVICE

CROSS-REFERENCE TO RELATED APPLICATIONS

This application is a division of U.S. patent application Ser. No. 10/944,050, filed on Sep. 20, 2004 now U.S Pat. No. 7,281,342, which application is a continuation of U.S. patent application Ser. No. 09/926,086, which application was filed as a national stage of PCT/FR00/03661 filed Dec. 22, 2000 and is now U.S. Pat. No. 6,802,439, issued on Oct. 12, 2004, the disclosure of the patent and all of the foregoing applications being hereby incorporated by reference thereto in their entireties.

This application claims priorities under 35 U.S.C. §119 of French Patent Application No. 99/16846, filed on Dec. 28, 1999, and of French Patent Application No. 00/06960, filed on May 26, 2000, the disclosures of which are hereby incorporated by reference thereto in their entireties.

BACKGROUND OF THE INVENTION

1. Field of the Invention

The invention relates to a tight lace-up device using a lace-type linkage and adapted to equip an article of footwear used, in particular, but in a non-limiting fashion, in sporting activities. The invention also relates to such article of footwear equipped with such device. Tight lacing, according to the invention, is more specifically adapted to shoes whose upper is reinforced, and which are used in particular for snowboarding, in-line roller skating, alpine skiing, mountain skiing and telemark skiing, ice skating, etc.

2. Description of Background and Relevant Information

To tighten a shoe of the aforementioned type properly, it is necessary to tie the lace tightly. In addition, using a lace-type tightening makes it possible to preserve a lightweight and inexpensive system, as compared to the other mechanical locking means, such as buckles. However, to obtain a tight lacing, it is necessary to reduce the friction of the lace in the lace returns. The improved sliding occurs in particular by reducing the section of the lace, which reduces the friction contact surface. Nevertheless, the small section of the lace tends to cause a painful shearing effect in the hand, and this prevents the user from applying enough tension in order to efficiently tighten the shoe.

French Application Publication No. 2 752 686 proposes a first alternative by describing a lace having variable sections. The central portion is small in diameter so as to slide easily in the returns, and the ends of the lace have larger sections in order to provide greater comfort for the hands. However, even though this system makes it possible to tension the lace correctly, it does not make it possible to maintain the tension due to a locking of the lace by a knot. Indeed, during the time necessary required for tying the knot, the user is forced to release the tension in the lace. Furthermore, the system is expensive to implement, for it requires specific means for manufacturing the lace.

French Application Publication No. 2 706 743 describes a lace-up device where the lace, having a small cross section, passes in returns, minimizing the friction and forms a loop. The lace is locked by an independent locking element that slides along the lace outside the lacing zone. The locking element makes it possible to maintain the tension in the lace. However, the user cannot apply a substantial tension in the lace. Indeed, the user is forced to grab the loop of the lace with at least one finger and to pull on the lace, which quickly shears the skin due to the small diameter of the lace.

SUMMARY OF THE INVENTION

An object of the invention is to provide a lace-up device for an article of footwear using a linkage that makes it possible to ensure a tight lacing, while preserving the user's comfort during the tightening phase.

Another object of the invention is to propose an inexpensive lace-up device that does not require the use of specific means to manufacture the linkage.

To achieve these objects, the lace-up device according to the invention includes a linkage that connects, along a predetermined path, at least two return elements arranged on different portions of the article of footwear to be brought closer together, and which forms a loop located outside the tightening zone. The linkage is equipped in the area of the loop with a gripping device that enables the user to pull efficiently on the linkage with at least one hand. This gripping device includes a rigid structure or frame, making it possible to distribute the tension of the linkage over the hand. In addition, this lace-up device includes a locking mechanism integrated into the return elements that is positioned at the junction of the lacing zone and of the loop. Thus, the user can maintain the tension in the linkage and, therefore, in the lacing zone, during the locking.

In a first embodiment, the gripping device is positioned at one of the ends of the tightening zone.

In a second embodiment, the gripping device is positioned perpendicular to the tightening zone.

BRIEF DESCRIPTION OF DRAWING

The invention will be better understood and other advantages thereof will become apparent from the description that follows, with reference to the annexed drawings, whereby the description illustrates, by way of non-limiting examples, certain preferred embodiments. The drawings include the following views.

DETAILED DESCRIPTION OF THE INVENTION

Figure 1:
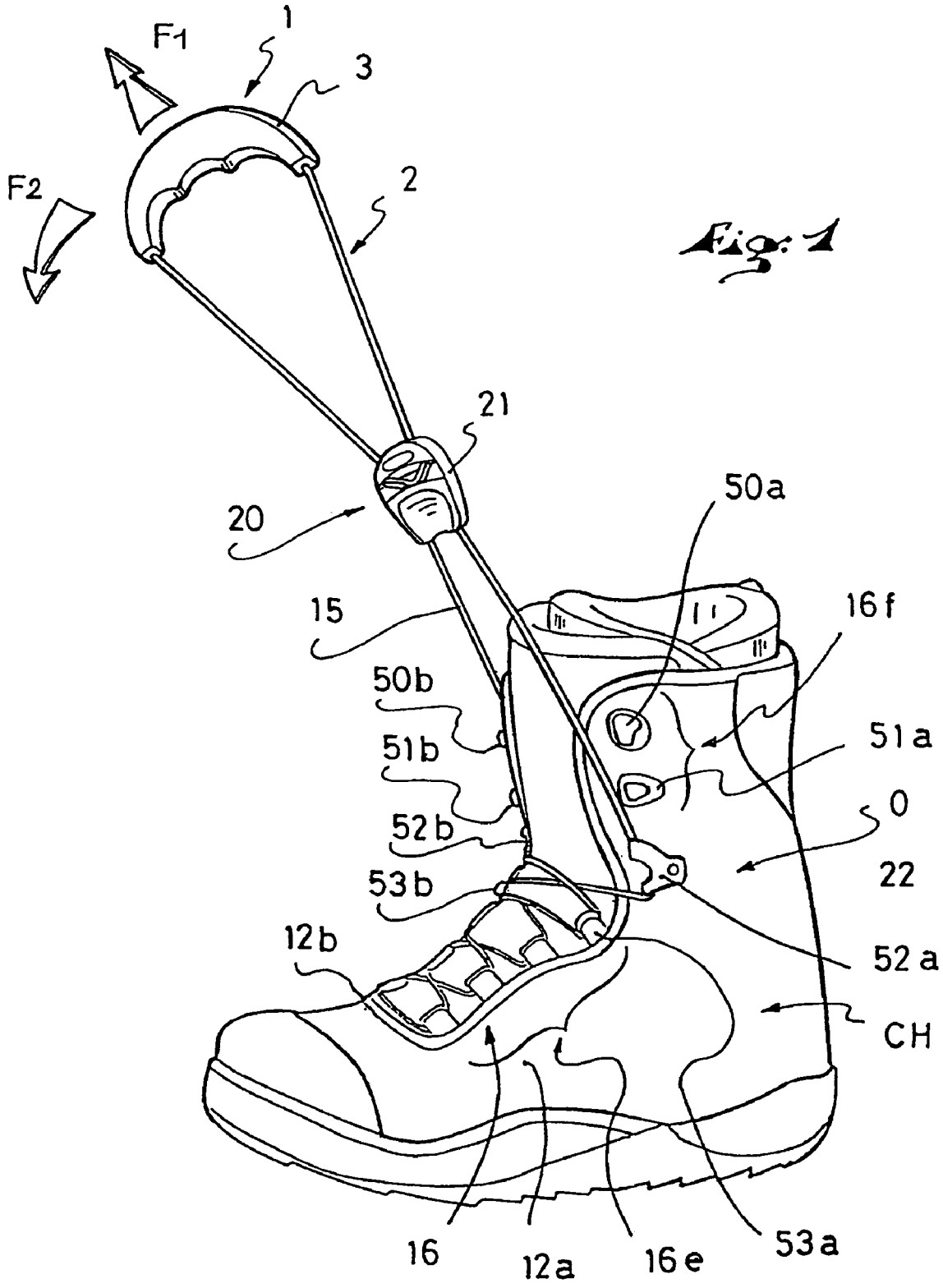
FIG. 1 shows a side view of a footwear equipped with the lace-up device according to the first embodiment in a first tightening phase.

In FIG. 1, the article of footwear CH shown is a snowboard boot. The invention applies to any type of boot whose flexible upper is reinforced either to increase the stiffness in bending of the upper, or to protect the foot and ankle from impacts and external attacks. This type of boot is found in sports such as snowboarding, in-line roller skating, and ice skating, for example.

The invention also applies to boots provided with an external rigid shell made of plastic, for example, and used, in particular, for alpine skiing, snowboarding, in-line roller skating, ice skating, mountain skiing, or telemark skiing, for example.

The article of footwear CH includes an upper O comprising a first portion 12*a* and a second portion 12*b*, which are transversely spaced apart on opposite sides of a vertical longitudinal median plane, and which are adapted to be brought closer together by a lace-up device. This lace-up device generally includes a tightening zone 16, which here is divided into two zones 16*e* and 16*f*, zone 16*e* being a lower tightening zone and zone 16*f* being an upper tightening zone. In a conventional and known manner, the tightening zone 16 comprises return elements 50*a*-54*a* and 50*b*-54*b* positioned on each of the two portions 12*a* and 12*b*, respectively. In other words, the tightening zones 16*e*, 16*f* have a length defined by the lowermost and uppermost return elements and a width defined between the line of return elements on each of the two portions 12*a*, 12*b* of the upper. A tongue, which extends transversely within the space between the two portions 12*a*, 12*b*, from a front end of the lower zone 16*e* to the upper end of the upper zone 16*f*, provides a portion of the outermost surface of the upper O.

A linkage 15, such as a lace or cable, connects at least two return elements 50*a* and 50*b* along a predetermined length of travel. The linkage 15 can advantageously connect all of the return elements to complete the tightening. In addition, the linkage 15 forms a loop 2 located outside the tightening zone 16.

To maintain the tension in the linkage 15, the lace-up device also includes a mechanism 20 for locking, or blocking, the linkage 15.

FIG. 1 more specifically illustrates a first tightening phase of the device, which is adapted to tighten a boot with a high upper. This phase ensures the tightening of the lower tightening zone 16*e*, which extends approximately from the metatarsophalangeal articulation up to the ankle, by making it possible to hold the instep firmly in the article of footwear CH. The lower tightening zone 16*e* includes a series of return elements 53*a* and 53*b* which advantageously specially adapted to make it possible to reduce the friction of the linkage 15 in the return elements.

Despite the use of specially adapted return elements as described in French Application Publication No. 2 706 743, tests have shown that it is preferable to limit to four, for example, the number of return elements 53*a* and 53*b* arranged on each of the portions 12*a* and 12*b* for each tightening zone 16*e* and 16*f* in order to optimize the tightening.

The upper end of the lower tightening zone 16*e* is demarcated by two return elements 52*a* and 52*b*, arranged on each of the portions 12*a* and 12*b* of the upper, which possibly have specific functions which will be detailed subsequently, and which separate the two tightening zones 16*e* and 16*f*.

The linkage 15, which extends from the return elements 52*a* and 52*b*, forms a loop 2 that includes a gripping device 1 arranged on the linkage 15. This gripping device 1 enables the user of the article of footwear CH to grab the loop 2 easily and, likewise, to exert a generally upward force F1 on the loop 2 easily. This force F1 generates a tension in each strand of the linkage 15 that contributes to the tightening power of the lace-up device by bringing the two portions 12*a* and 12*b* of the upper of the article of footwear closer together. However, since the tension in each strand of the linkage 15 corresponds substantially to one half of such force F1, it is important that the gripping device 1 ensure the user's comfort during the tightening.

To achieve this object, the gripping device 1 comprises a rigid frame or structure 3. This rigidity makes it possible to distribute the tension of the linkage 15 over the user's hand by limiting the shearing effect of the linkage on the skin. Thus, the more the pain on the hand is reduced, the more firmly the user can pull on the gripping device 1.

The rigid frame 3 can be advantageously made out of a material having a certain bending strength, in particular thermoplastic materials such as polyamide, polypropylene, and according to an adapted geometry that promotes greater inertia along the direction of force F1.

Once the tension is exerted in the linkage 15, it is necessary to maintain this tightening tension in order to be able to release the gripping device 1. This function is ensured by a locking mechanism 22 that is integrated into the return elements 52*a* and 52*b*. These elements 52*a* and 52*b* simultaneously ensure a sliding function in one direction, and a locking, or blocking, function in another direction. The return elements 52*a*, 52*b*, can be constructed as described in French Application Publication No. 2 757 026 and can be regarded as linkage-locking return elements.

To combine these two functions, the return elements 52*a* and 52*b* can be suitably oriented on the upper O, such that the force F1 on the linkage 15 makes it possible to slide the linkage in the return elements 52*a* and 52*b*, and also to exert a reverse-locking action. But the return elements 52*a* and 52*b* can also be oriented so as to promote the sliding along the direction of the force F1. Then, once the force F1 has been applied, the user exerts a force F2 oriented substantially forward. This force F2 changes the orientation of the linkage 15 in the return elements 52*a* and 52*b* and makes it possible to use the return elements 52*a* and 52*b* in their locking function.

To facilitate the sequence of the actions of tightening and loosening the lower tightening zone 16*e*, the return elements 52*a*, 52*b*, 53*a*, and 53*b*, which are located in the lower tightening zone 16*e*, include guiding means adapted to prevent the linkage 15 from escaping during the loosening. One way to implement these guiding means consists of using return elements which include a channel from which the linkage 15 cannot escape unexpectedly.

Figure 2:
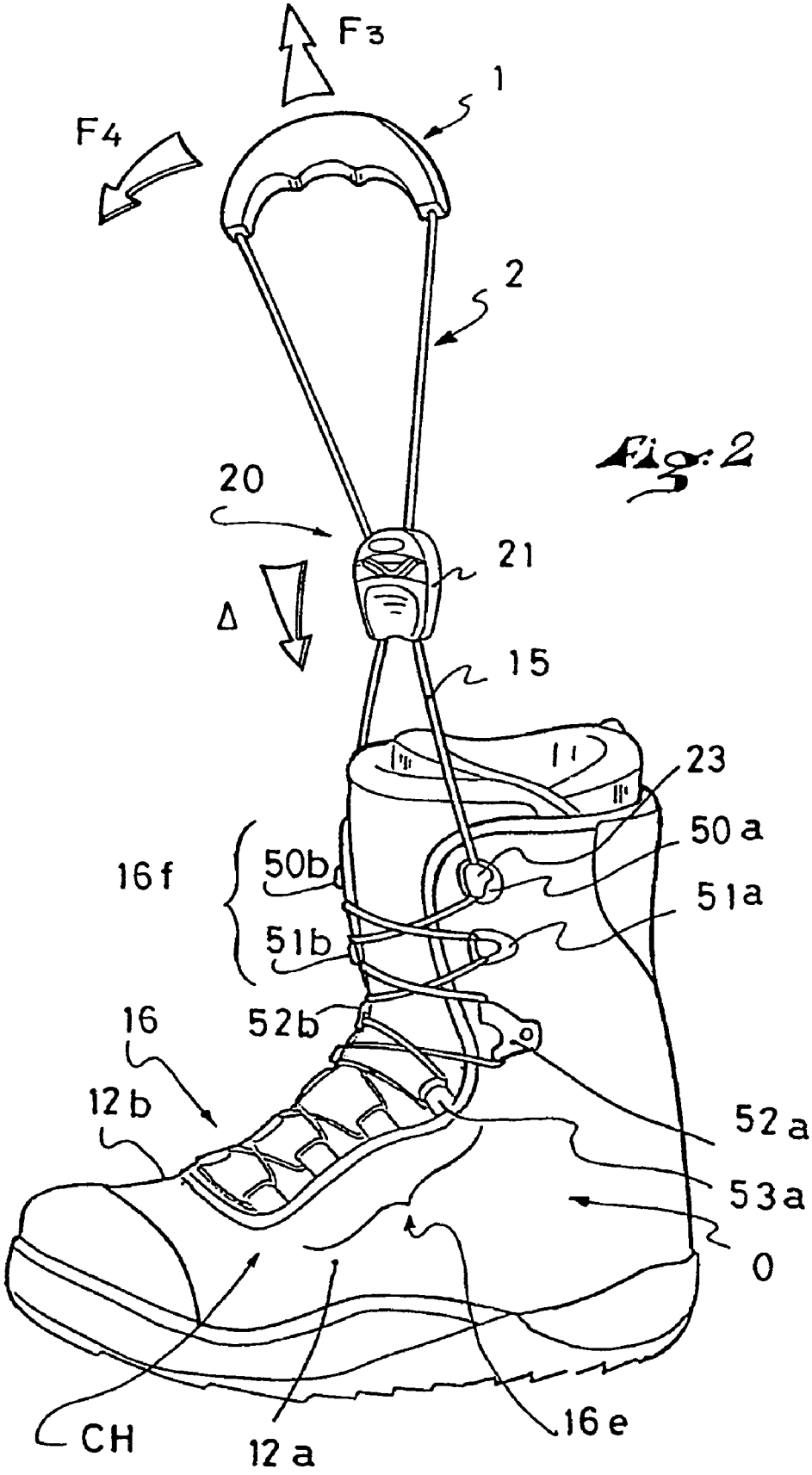
FIG. 2 shows a side view of the footwear equipped with the lace-up device according to the first embodiment in a second tightening phase.

FIG. 2 shows the second and last tightening phase of the footwear CH, which is still a boot adapted to snowboarding. This tightening phase makes it possible to tighten the upper tightening zone 16*f* by bringing the portions 12*a* and 12*b* of the upper O closer together. The lace-up device of the invention, therefore, makes it possible to separate the tightenings and their intensities for the lower tightening zone 16*e* and the upper tightening zone 16*f*. Indeed, the tightening of the upper tightening zone 16*f* does not have any effect on, that is, is independent of, the tightening of the lower tightening zone 16*e* due to the locking function of the linkage 15 which is integrated into the return elements 52*a* and 52*b*.

To undertake the second tightening phase, the user first positions the linkage 15 manually in the return elements 51*a* and 50*a* and their counterparts, located on the opposite portion 12*b*. The user crisscrosses the linkage 15 in a known fashion by going upward from the return element 52*a* to the return element 50*a*. To be able to perform this manual operation, the return elements 50*a*, 50*b*, 51*a*, and 51*b*, located in the upper tightening zone 16*f*, are of the hook type. In other words, they are open so as to retain the linkage 15 in the direction that brings the two portions 12*a* and 12*b* of the upper O closer together.

Once the linkage 15 is positioned, the user pulls, along a substantially upward force F3, on the gripping device 1 which is positioned on the linkage 15 in the area of loop 2. This action tensions the linkage 15 which brings the two portions 12*a* and 12*b* of the upper O closer together, in the area of the upper tightening zone 16*f*. The tightening tension is maintained in this zone 16*f* due to a means for locking the linkage 15.

This locking can be obtained in two different ways. First, the return elements 50*a* and 50*b*, which are positioned at the end of the tightening zone 16, and at the junction of the upper tightening zone 16*f* and the loop 2, integrate a locking means 23. This locking means is substantially similar to the locking means 22 arranged on the return elements 52*a* and 52*b* and described previously. Similarly, the user can lock the linkage 15 by pulling along the direction of the force F3 if the return elements 50*a* and 50*b* are arranged on the upper O along a specific orientation. Conversely, the user pulls on the gripping device 1 with the force F3, then displaces the device 1 forwardly along a direction F4 to ensure the locking of the linkage 15 according to a previously described mechanism.

Second, the locking means 20 can be integrated into an independent locking element 21 that is slidably mounted on the loop 2. To perform the locking, the user pulls on the gripping device 1 along the direction F3, then displaces the locking element 21 along a direction Δ that brings the locking element 21 closer to the return elements 50*a* and 50*b*. Preferably, the locking element 21 is slidably mounted concurrently on the two strands of the loop 2. The locking means 20 can be embodied as two locking elements sliding on each of the strands of the loop 2, respectively. In this case, the user must displace the two locking elements to lock the linkage 15.

Moreover, the two aforementioned locking devices can be combined for increased safety against an ill-timed loosening, which may occur on this type of boot, which can be subject to substantial forces during the sporting activity. FIG. 2 shows this combination with locking means 23 integrated into the return elements 50*a* and 50*b* and the locking element 21 mounted on the loop 2 of the linkage 15.

The tests conducted have shown the interest of using a flexible and substantially non-stretching linkage 15. The flexibility is necessary in the travel imposed by the position of the return elements, and the non-stretching ability makes it possible to limit the elongation of the linkage 15, in particular in the area of the loop 2, during the tightening.

Indeed, the tension obtained by the rigid frame 3 of the gripping device 1 is so substantial that, in the case of a conventional lace, or even a string, the user would spend his energy in untying the lace instead of bringing the two portions 12*a* and 12*b* closer together. The best results were obtained with a linkage 15 obtained with a linkage made of kevlar or aramid, and whose outer diameter is between 2 and 4 mm.

Figure 3:
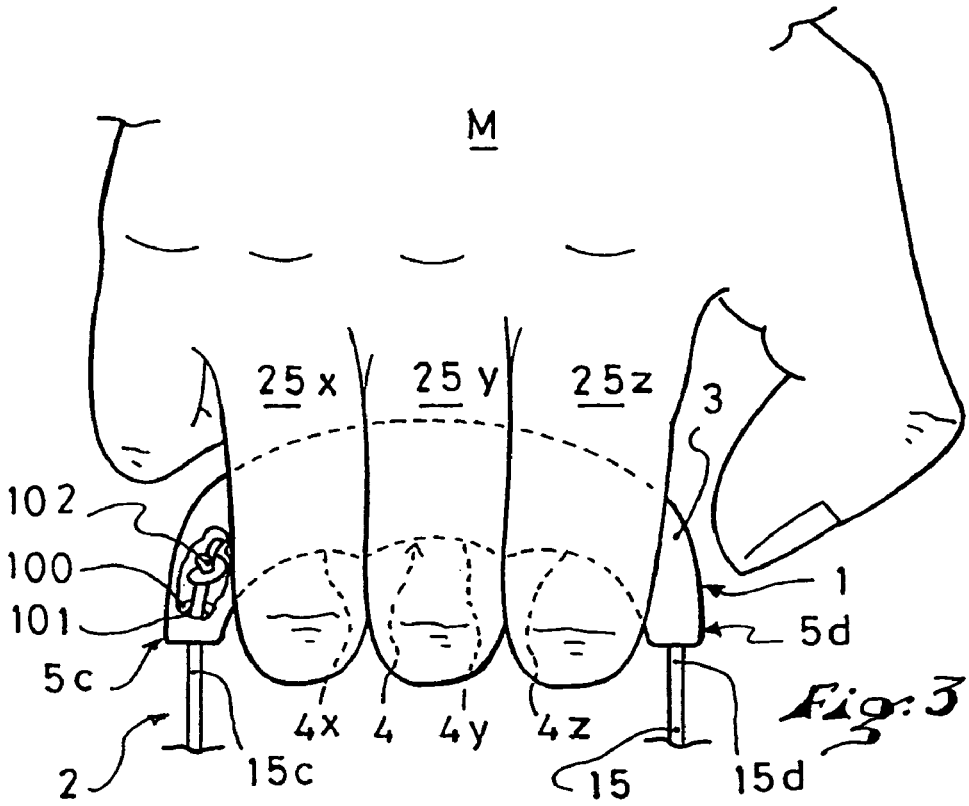
FIG. 3 shows a front view of a detail of the gripping device.

FIG. 3 shows a detail of the lace-up device in the area of the gripping device 1 and its rigid frame 3. This frame 3 comprises a contact surface 4 which is complementary of at least three fingers 25*x*, 25*y*, and 25*z* of the hand M. This contact surface 4 comprises three cavities 4*x*, 4*y*, and 4*z* which assume the morphology of the fingers 25*x*, 25*y*, and 25*z*, respectively, when folded around the frame 3. Tests have shown that to obtain a more powerful tightening, the fingers used preferably are the forefinger, second finger, and third finger.

In addition, in the preferred embodiment shown, the frame 3 also serves to close the loop 2 constituted by the linkage 15. The gripping device 1 includes hooking zones, or connection arrangements, 5*c* and 5*d* that are adapted to cooperate with the two ends, or end portions, 15*c* and 15*d*, respectively, of the linkage 15. The connection arrangements 5*c*, 5*d* can be constituted by a wall 100, perpendicular to the linkage 15, which is integral with the rigid frame 3. A hole 101 in which the end 15*c* of the linkage 15 passes is provided in this wall 100. This end 15*c* is equipped with a locking means, such as a knot 102 whose diameter is greater than the diameter of the hole 101.

Figure 4:
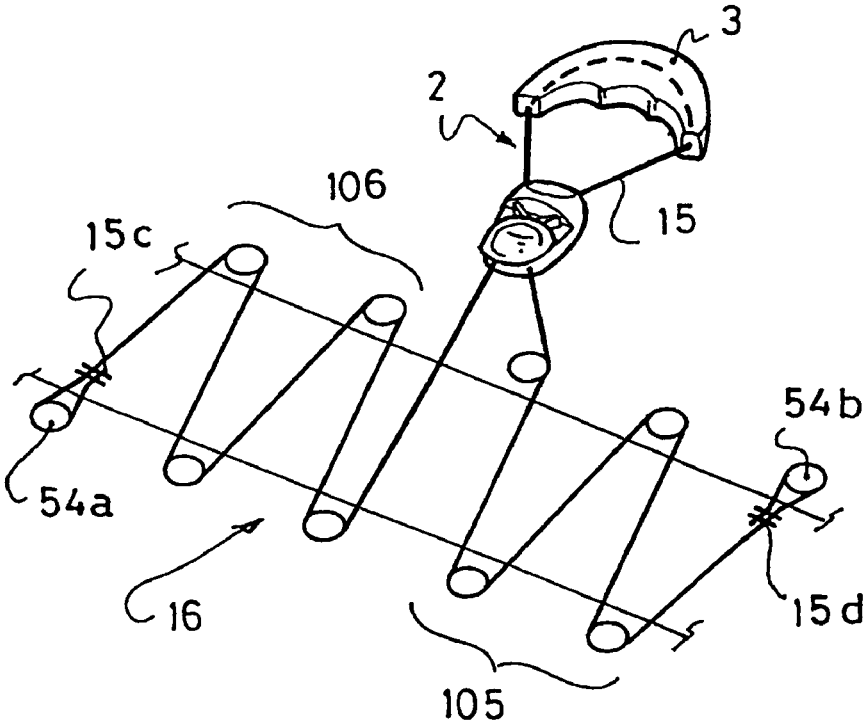
FIG. 4 shows a three-quarter top view of the lace-up device according to the second embodiment.

As shown in FIG. 4, the linkage 15 can also extend right through the frame 3. However, like the gripping device shown in FIG. 3, the frame 3 serves to separate, i.e., to space apart, the linkage portions that are connected to, or pass through, the frame to allow the fingers of the hand to extend within the loop 2. The ends 15*c* and 15*d*, or end portions, of the linkage 15 are connected to return elements 54*a* and 54*b* located substantially at the ends of the tightening zone 16. However, in this embodiment, the loop 2 which includes the frame 3 is not located at one of the ends of the tightening zone 16. The loop 2 is located outside the tightening zone 16, but extends substantially perpendicular to the plane defined by the tightening zone 16 so as to divide the zone 16 into two tightening sub-zones 105 and 106.

As can be seen in FIG. 4, a linkage strand extends from an upper end of the lower tightening sub-zone 105 outside of the tightening zone 16 and another linkage strand extends from a lower end of the upper tightening sub-zone 106 outside of the tightening zone. In this particular embodiment, the two strands extend outside the width of the tightening zone 16 and, lengthwise of the tightening zone 16, intermediate the ends of the tightening zone 16. This arrangement provides the convenience, as shown, of enabling a user to apply a tensioning force on both of the two strands with a single gripping device or frame 3 and a single linkage lock for both of the two strands.

Furthermore, the gripping. device can be provided with an improvement not shown. In this improvement, the gripping device includes a fastening means complementary of the article of footwear which makes it possible to store the gripping device on the article of footwear. This fastening means can advantageously be of the self-gripping type, or in the form of a snap-fastener. The footwear can also be provided with a pocket or a strap forming a loop in which the gripping device could be housed when it is out of the tightening and loosening phases. In addition, the gripping device can advantageously include comfort elements constituted of a softer material than that of the frame, and positioned in the area of the contact surface adapted to be in contact with the fingers of the hand.

The present invention is not limited to the embodiments described hereinabove, which are provided for guidance only, but encompasses all similar or equivalent embodiments.

The invention claimed is:

1. An article of footwear comprising:

an upper including at least a first portion and a second portion, the first and second portions of the upper being spaced apart and adapted to be brought towards one another during tightening of the article of footwear;

a first plurality of return elements affixed to said first portion of said upper and a second plurality of return elements affixed to said second portion of said upper, said first and second pluralities of return elements describing a tightening zone;

a linkage guided in a predeterminate path via at least said first and second pluralities of return elements of said upper;

said linkage having two ends, with a number of return elements positioned between said two ends, said linkage forming one strand, said one strand adapted to be spaced beyond said tightening zone while the article of footwear is tightened;

a locking arrangement for locking said linkage at least while the article of footwear is tightened;

at least one gripping device secured to said linkage, said gripping device comprising a loop for a hand of the user enabling the user to apply a tension force, intermediate lower and upper ends of said tightening zone, to said one strand of said linkage with at least one hand during said tightening of the article of footwear.

2. An article of footwear according of claim 1, wherein:

said path extends across a vertical median plane of the article of footwear.

3. An article of footwear according of claim 1, wherein:
said gripping device further comprising a force-distributing frame for the hand of the user.

4. An article of footwear according of claim 3, wherein:
said frame is rigid.

5. An article of footwear according of claim 1, wherein:
said at least one gripping device consists of a single gripping device.

6. An article of footwear according of claim 1, wherein:
said tightening zone extends from a lower end to an upper end;
said loop extends outside said tightening zone intermediate said lower and upper ends of said tightening zone.

7. An article of footwear according to claim 6, wherein:
said lower end of said tightening zone is located approximately in a metatarsophalangeal articulation area.

8. An article of footwear according to claim 6, wherein:
a first of said two ends of said linkage is located substantially at said lower end of said tightening zone and a second of said two ends of said linkage is located substantially at said upper end of said tightening zone.

9. An article of footwear according to claim 8, wherein:
said upper is a high upper including a lower portion extending over a foot of the user and an upper portion extending along a part of a lower leg of the user;
said tightening zone comprises an upper tightening zone extending along said upper portion of said upper and a lower tightening zone extending along said lower portion of said upper.

10. An article of footwear according to claim 1, wherein:
said first and second portions of said upper extend along opposite sides of a vertical longitudinal median plane of the article of footwear;
said upper further comprises a tongue extending transversely between said first and second portions of said upper, forming a portion of an outermost surface of said upper, said tongue being positioned beneath said linkage in said tightening zone.

11. An article of footwear comprising:
an upper including at least a first portion and a second portion, the first and second portions of the upper being spaced apart and adapted to be brought towards one another during tightening of the article of footwear;
a first plurality of return elements affixed to said first portion of said upper and a second plurality of return elements affixed to said second portion of said upper, said first and second pluralities of return elements describing a tightening zone, said tightening zone extending from a lower end to an upper end;
said tightening zone comprising a first tightening sub-zone and a second tightening sub-zone;
a first strand of a lace or cable guided in a predetermined path via at least said first and second pluralities of return elements and extending within said first tightening sub-zone from an end proximate said lower end of said tightening zone.
a second strand of a lace or cable guided in a predetermined path via at least said first and second pluralities of return elements and extending within said second tightening sub-zone from an end proximate said upper end of said tightening zone;
a lock for said first strand and a lock for the second strand, at least said lock for said first strand being located on said first strand as said first strand exits said tightening zone at a position intermediate said lower end and said upper end of said tightening zone, said locks being adapted to lock said first and second strands while the article of footwear is tightened;
a gripping device secured at least to one of said first and second strands, said gripping device comprising a loop for a hand of the user for enabling a user to exert a tension force to tighten the article of footwear.

12. An article of footwear according to claim 11, wherein:
said lock for said first strand and said lock for said second strand are embodied as a single locking element slidably mounted on said first and second strands.

13. An article of footwear according to claim 11, wherein:
said first and second strands are part of a single linkage extending from proximate said lower end of said tightening zone to said upper end of said tightening zone.

14. An article of footwear according to claim 11, wherein:
said gripping device comprises a force-distributing frame for the hand of the user.

15. An article of footwear according to claim 14, wherein:
said frame is rigid.

16. An article of footwear according to claim 11, wherein:
said first and second portions of said upper extend along opposite sides of a vertical longitudinal median plane of the article of footwear;
said upper further comprises a tongue extending transversely between said first and second portions of said upper, forming a portion of an outermost surface of said upper, said tongue being positioned beneath said linkage in said tightening zone.

17. An article of footwear according to claim 16, wherein:
said upper is a high upper covering an area of an ankle of a user.

18. An article of footwear according to claim 1, wherein:
said linkage is flexible and has a non-stretching ability.

19. An article of footwear comprising:
an upper including at least a first portion and a second portion, the first and second portions of the upper being spaced apart and adapted to be brought towards one another during tightening of the article of footwear;
a first plurality of return elements affixed to said first portion of said upper and a second plurality of return elements affixed to said second portion of said upper, said first and second pluralities of return elements describing a tightening zone having a length and a width, said length extending between a first end and a second end, said width extending between a first side and a second side;
a linkage guided in a predeterminate path via at least said first and second pluralities of return elements of said upper, said linkage comprising a first strand and a second strand;
said first strand of said linkage crossing one of said first and second sides of said tightening zone and thereby providing a portion of said first strand extending outside said width of said tightening zone intermediate of said length of said tightening zone;
said second strand of said linkage crossing one of said first and second sides of said tightening zone and thereby providing a portion of said second strand extending outside said width of said tightening zone intermediate said ends of said tightening zone;
said portion of said first strand and said portion of said second strand of said linkage being adapted to have a tensioning force applied along respective lengths of said portions to tighten said upper of the article of footwear by bringing together said first and second portions of said upper; and a locking arrangement to lock said linkage in a tightened position.

20. An article of footwear according to claim 19, further comprising:

a gripping device secured at least to one of said first and second strands, said gripping device comprising a rigid force-distributing handle adapted to be gripped simultaneously by a plurality of fingers of a user's hand for applying the tightening force to said linkage to place said linkage in said tightened position.

21. An article of footwear according to claim 20, wherein:

said first and second strands, with said gripping device, form a loop outside said width of said tightening zone.

22. An article of footwear according to claim 19, wherein:

said linkage consists of a single strand having only two ends.

23. An article of footwear according to claim 19, wherein:

said upper is a high upper comprising a lower portion adapted to cover a user's foot and an upper portion adapted to extend above the user's ankle and along the user's lower leg.

24. An article of footwear according to claim 19, wherein:

both of said first and second strands of said linkage cross said first side of said tightening zone, thereby providing respective portions of said first and second strands extending outside said width of said tightening zone intermediate of said length of said tightening zone.

* * * * *